United States Patent [19]

Hall

[11] Patent Number: 4,673,196

[45] Date of Patent: Jun. 16, 1987

[54] GUARD FOR SKATES

[76] Inventor: Bradley G. Hall, 60 Redcar Ave., Islington, Toronto, Ontario, Canada, M9B 1K1

[21] Appl. No.: 366,857

[22] Filed: Apr. 9, 1982

[30] Foreign Application Priority Data

Mar. 1, 1982 [CA] Canada ..... 397297

[51] Int. Cl.[4] ..... A63C 3/12

[52] U.S. Cl. ..... 280/825

[58] Field of Search ..... 280/825; 30/151, 286, 30/295; 24/222, 224 R, 217 R

[56] References Cited

U.S. PATENT DOCUMENTS 4,264,090 4/1981 Davies ..... 280/825

FOREIGN PATENT DOCUMENTS

| | | | |
|---|---|---|---|
| 1063637 | 10/1979 | Canada | 280/825 |
| 579716 | 6/1933 | Fed. Rep. of Germany | 280/825 |
| 13751 | of 1896 | United Kingdom | 280/825 |
| 379611 | 9/1932 | United Kingdom | 280/825 |

*Primary Examiner*—John J. Love
*Assistant Examiner*—Michael Mar
*Attorney, Agent, or Firm*—Westell & Hanley

[57] ABSTRACT

A skate guard of flexible resilient material defines a longitudinally extending upwardly opening groove of a width to receive a skate blade. Flexible fins extend into the groove from each side and are designed to be deflected downwardly by the insertion of a skate blade.

12 Claims, 5 Drawing Figures

22
20

32
14
29
26
34
B
30
A
32
14
24
29

31
32
11
~12~
14
24
30
11
34
32
31

23
12F
14F

GUARD FOR SKATES

This invention relates to a skate guard of the type which may be applied to an ice skate.

It is an object of the invention to provide such a skate guard which may be applied to the ice skate, for use and wear when the wearer is not skating, whereby the wearer may walk on non-ice surfaces on the guards, with such guards securely attached.

It is an object of the invention to provide a skate guard for attachment to an ice skate which guard is secured to the skate by side pressures of the skate on the guard, rather than by tensioning over both ends of the blade or by the use of hooks, springs or other attachments.

It is an object of the invention to provide a skate guard having a longitudinally extending groove to receive the blade and wherein longitudinally extending flexible fins project from opposite groove walls into the groove, to an extent to be deflected downward by the skate blade on the latter's insertion into the groove whereby the fins act to retain the blade in the guard.

It is an object of the invention to provide a skate as discussed in the previous paragraph wherein the bottom of the guard, in transverse cross-section, is concave downward so that the initial contact of the guard with a surface walked on by the wearer is along two outside ridges. The bending of the guard under the wearer's weight narrows the groove near the top, exerting clamping pressure on the blade which augments the retentive forces achieved through the fins.

It is an object of the invention to provide a skate guard using fins as previously discussed and having for the groove an end stop to assist in the insertion of the skate in the guard and to prevent longitudinal movement between the skate and the guard.

It is an object of the invention to provide a skate guard using the fins previously discussed which is suitable for construction using plastic extrusion techniques.

It is an object of the invention to provide a skate guard using the fins previously discussed which is suitable for construction using plastic extrusion techniques and which, by removal of a section near one end of the extrusion may be folded upward to form an end stop for the blade in the groove.

The closest prior art known to applicant comprises co-pending application Ser. No. 121,455, now U.S. Pat. No. 4,365,828, filed by this applicant and two others, on Feb. 14, 1980 and entitled SKATE GUARD; and the patents cited against such application, its corresponding Canadian and another U.S. counterparts.

Such cited patents are as follows:

Canadian No. 272,993, Whitley;
Canadian No. 519,852, Lockington;
U.S. Pat. No. 2,181,834, Pierce et al;
U.S. Pat. No. 3,637,231, Weidenbacker;
G.B. No. 379,611, Dornseif;
G.B. No. 536,193, Riordan;
Germany No. 579,716, Dornseif;
Canadian No. 671,133, Tyrrell;
U.S. Pat. No. 2,536,382, Matchett;
U.S. Pat. No. 46,563, Hook et al;
U.S. Pat. No. 2,096,781, Blochinger;
U.K. No. 13,751, Gould.

Co-pending application Ser. No. 121,455 is directed to a guard primarily designed for moulding rather than extrusion and using an upwardly tapering groove rather than fins.

Of the cited patents: Whitley, Lockington, Pierce, both Dornseif patents, Riordan and Gould are directed to skate guards which are attached by hooks, straps or springs or by tensioning over both ends of the skate. Matchett, Hook and Blochinger are directed to antiquated and irrelevant constructions Tyrrell is directed to a chain saw guard. Weidenbacker, in common with the other patents does not show the use of fins in the guard groove as the primary means for retaining the guard on the blade. Moreover, none of the patents with the exception of a few of the Weidenbacker embodiments shows a guard suitable for production by extrusion techniques; and such Weidenbacker embodiments do not disclose a guard having features relevant to the inventive features of this invention.

In drawings which illustrate a preferred embodiment of the invention:

Figure 1:
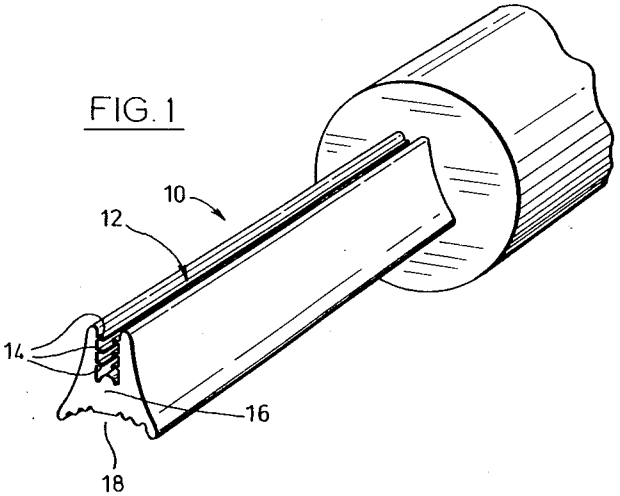
FIG. 1 shows an extrusion from which the guard may be constructed.

In the drawings, FIG. 1 shows an extrusion 10 shaped to define an upwardly facing groove 12, fins 14 extending transversely into the groove from opposite sides, a widened base 18 and a concave downward lower surface on the base. These parts will be more fully described hereafter.

Figure 2:
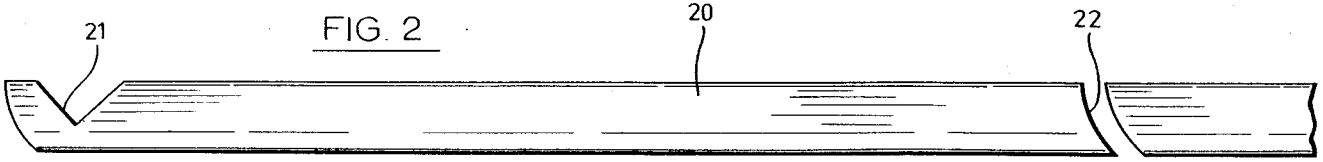
FIG. 2 shows the cutting and notching of the extrusion for forming the guard.

FIG. 2 shows a length cut from the extrusion by parallel (although not necessarily exactly straight) cuts 22. The angle and the contour of the cut is selected to give a pleasing shape to the upturned front of the guard as formed in FIG. 3. FIG. 2 also shows that for each guard length a 90° V cut out (in side view) 21 is removed from the upper surface of the guard, near one end, to a sufficient depth to allow the guard end to be folded 90° upwardly to close the cut and fixed by heat welding in the raised position along line 23 as shown in FIG. 3.

It is noted that the preferred material for the extruded guard is polyvinyl chloride (PVC) and that preferably two types of PVC are combined in the extrusion so that while the fins and the remainder of the guard are both made of PVC which is to some degree resiliently bendable and compressable, the fins are made of a more flexible type of PVC than that used for the rest of the guard.

Figures 3, 4, 5:
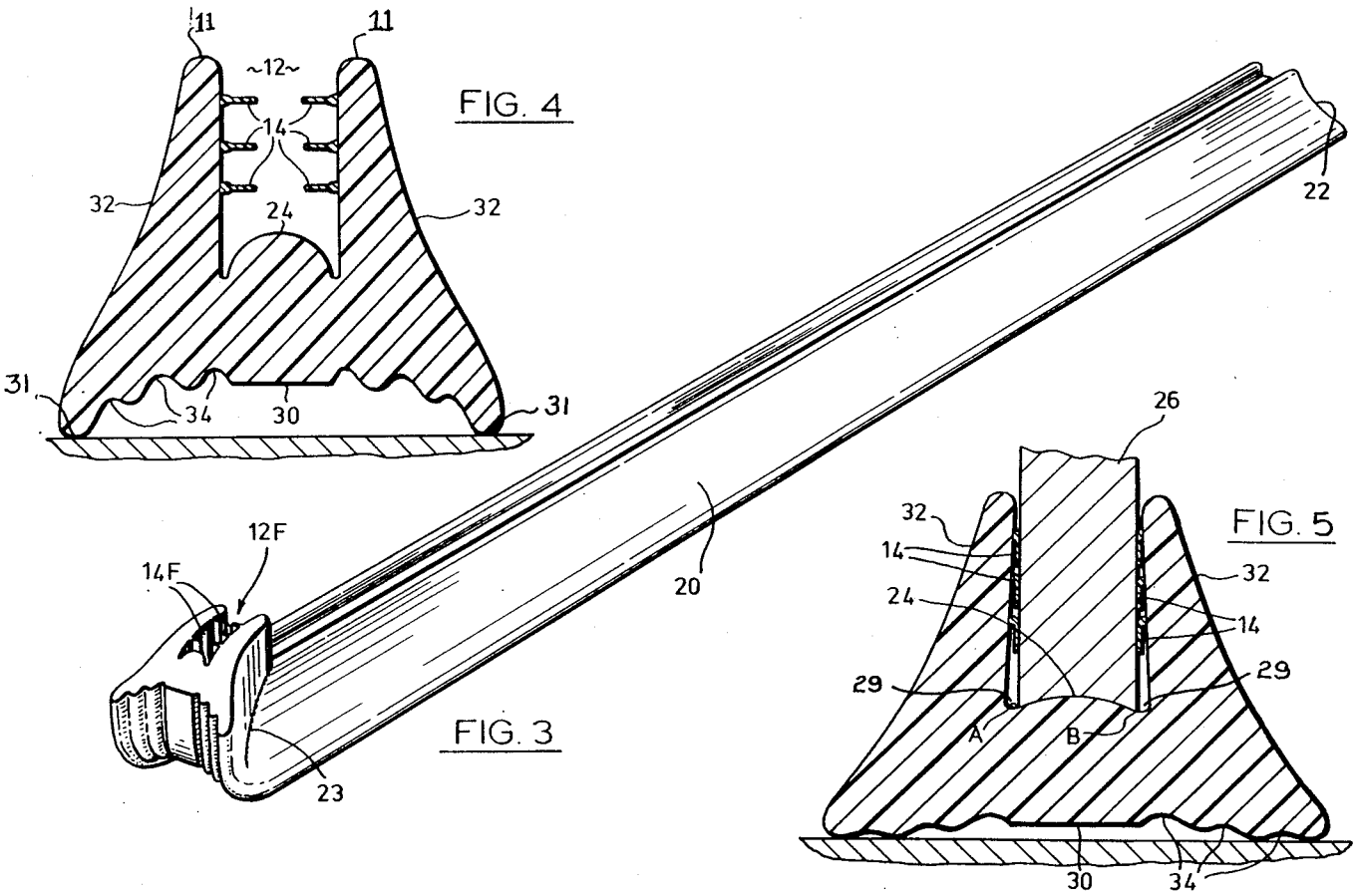
FIG. 3 shows a guard formed from the cut extrusion of FIG. 3.
FIG. 4 shows a cross section of the guard before a skate blade is inserted therein.
FIG. 5 shows the cross-section of FIG. 4, with the skate blade inserted in the guard.

It is also noted that the guard of FIG. 3 is preferably cut to be longer than any of the range of skate blades for which it is provided. It is desireable that the skate guard be just longer than the blade with which it is used. Accordingly, it is preferable to sell a guard longer than any user's need and the user may then cut it to a length just longer than the user's particular blade.

FIG. 4 shows a cross section of the guard before insertion of the blade. As shown the guard defines an upwardly opening groove 12 slightly wider than the blade 26 with which it is used. A plurality of flexible fins (preferably in opposed pairs) extend transversely into the passage. The fins 14 are dimensioned so that the clearance between opposite fin extremities is substantially less than the thickness of the skate blade. Thus the blade 26 on its insertion into the groove deflects the fins downwardly. The fins 14 in turn bear upon the blade 28 and act to retain it in the grooves.

The root of the groove (FIG. 4) is shaped to form a rib 24 convex upward in transverse cross-section, having the width of the groove and preferably running the length thereof. The convex upward rib 24 is designed to have a smaller radius than that of a hollow ground skate blade. Thus the blade 26 on insertion will initially contact the rib 24 at the centre highest point being spaced from it on either side. When the blade is fully pressed into the groove, followed by the application of the weight of the wearer through the blade to the guard, the compressibility of the PVC forming the rib is sufficient that the rib 24 is flattened to conform to the skate blade 28 (FIG. 5). With most skates (except for some figure skates), the edges of the hollow ground blade, being just narrower than the groove and the rib, bite into the outer material of the rib (as shown at A and B in FIG. 5) and act to center the blade in the guard. Moreover, small channels 29 remain at the root of the groove, on each side of the groove to allow the drainage of water from the guard.

As shown in FIG. 4, the guard is shaped to widen toward the base and to be concave downwards when there is no weight on the guard. However, as shown in FIG. 5 with the blade in the guard and the user's weight thereon, the concavity is flattened. There is a downwardly widening shape of the guard between the upper lips 11 defining the opening of the groove and the lower ridges 31. Thus the weight of the user, initially borne by ridges 31 causes the flattening of the concavity and applies stress to the guard body tending to move the upper lips 11 of the guard inwardly and causing them, through the fins 14 to press inwardly on the skate blade. The pressure increases the frictional retention of the blade by the fins 14. It will be noted that such increased frictional retention by the fins is maximized, when it is most needed, that is when the wearer is walking on the guards with his skates on.

It will be noted that the lips 11 defining the upper opening of the groove are preferably rounded to provide sloping surfaces which assist in guiding the blade into the groove.

It will be noted that the concave downward lower surface of the guard is provided with a tread formed by shallow longitudinally extending grooves 34. This has two advantages. Firstly, the tread thus formed increases the frictional purchase of the guard on a surface. Secondly, the grooves 34 assist in the drainage of water from under the guard when in use.

The guard is particularly designed for production by extrusion and it will be obvious that such extrusion together with the mode of forming the forward stop provides a suitable guard having the advantages described.

However, it is noted that the fins, augmented in their frictional effect by the concave downward guard bottom, preferably accompanied by the downwardly gradually widening guard shape and the special rib are achievable in a moulded product or product otherwise produced than by extrusion. Thus a guard having the features hereafter claimed, and produced otherwise than by extrusion is considered within the scope of the invention.

Moreover although the fins are shown running the length of the guard, the fins may be in short, broken lengths at suitable locations along the guard length and this is considered within the scope of the invention.

Further the guard is shown as a single integral product (even though the ribs are preferably a slightly different PVC product). However, it is within the scope of the invention to provide a guard made of two or more members fitted together.

It should be emphasized that the raised guard end has advantages, not only that it provides a stop and datum for the blade on insertion into the guard, but in its preferred form, provides a rearwardly facing groove 12F, with fins 14F which tend to grasp the front of the blade, and increase the securement of the guard to the blade.

It is noted that it is within the invention that the upturned end be used as well for the rear as the front of the guard. However, the natural usage will be to place the upturned end at the front.

It is noted that with the upturned end at one end of the guard and the guard at the other extending slightly beyond the end of the skate, which is the preferred arrangement, the other end will become slightly upturned under constant use tending to form a second stop at the other end of the guard.

I claim:

1. Skate guard of flexible resilient compressible material:

a longitudinally extending body, defining a longitudinally extending upwardly opening groove of a width to receive a skate blade, fins inwardly extending into said groove from each of the defining side walls of the groove, defining a transverse clearance of less than the thickness of the skate blade between the inner extremities of the fins extending from opposite sides of the groove, said fins being designed to be flexible and to be directed downwardly by the insertion of a skate blade into said groove, wherein said guard and said fins are formed by an integral extrusion, said guard in transverse cross-section widening toward the base thereof.

2. Skate guard as claimed in claim 1 wherein said fins are made of a more flexible material than the main part of said body.

3. Skate guard as claimed in claim 2 having an upturned end portion.

4. Skate guard as claimed in claim 2 having a rib formed from the guard material, convex upward in transverse cross-section of the guard at the bottom of said groove, said convex rib having a smaller radius of curvature than that of a hollow ground skate blade.

5. Skate guard as claimed in claim 1 having an upturned end portion.

6. Skate guard as claimed in claim 1 having a rib formed from the guard material, convex upward in transverse cross-section of the guard at the bottom of said groove, said convex rib having a smaller radius of curvature than that of a hollow ground skate blade.

7. Skate guard as claimed in claim 6 wherein said convex upward rib in transverse cross-section extends substantially the width of the groove.

8. A guard as claimed in any one of claims 1,2,5,3,6 or 4 having a widened base, the bottom of said base being shaped to be concave downward in transverse cross-section.

9. Skate guard of flexible resilient compressible material:

a longitudinally extending body, defining a longitudinally extending upwardly opening groove of a width to receive a skate blade, fins inwardly extending into said groove from each of the defining side walls of the groove, defining a transverse clearance of less than the thickness of the skate blade between the inner extremities of the fins extending from opposite sides of the grooves, said fins being designed to be flexible and to be directed downwardly by the insertion of a skate blade into said groove, wherein said guard and said fins are formed by an integral extrusion, said guard in transverse cross-section widening toward the base thereof, having an upturned end portion formed by removing, adjacent said end an upper portion of the guard material, in the shape of a V in side view, sufficient to allow the guard to be bent about the removed V portion, and fixed in bent position, so that the V is closed, and there is thereby formed an upturned end portion having a rearwardly facing groove therein.

10. Skate guard as claimed in claim 9 having a rib formed from the guard material, convex upward in transverse cross-section of the guard, at the bottom of said groove, said convex rib having a small radius of curvature than that of a hollow ground skate blade.

11. Skate guard as claimed in claim 10 wherein said convex upward rib in transverse cross-section extends substantially the width of the groove.

12. Skate guard as claimed in claim 9 or 10 having a widened base, the bottom of said base being shaped to be concave downward in transverse cross-section.

* * * * *